United States Patent [19]

Chambos

[11] 3,952,621

[45] Apr. 27, 1976

[54] POTATO CUTTING MACHINE

[76] Inventor: James Chambos, 218 Garrison Road, Williamsville, N.Y. 14221

[22] Filed: Dec. 6, 1974

[21] Appl. No.: 530,081

[52] U.S. Cl. ..... 83/733; 83/9; 83/408; 83/425.1; 83/856

[51] Int. Cl.[2] ..... B26D 1/02

[58] Field of Search ..... 83/404, 408, 733, 9, 83/10, 425.1, 856, 12, 423, 431

[56] References Cited

UNITED STATES PATENTS

| | | | |
|---|---|---|---|
| 2,156,645 | 5/1939 | Waller | 83/733 |
| 2,464,993 | 3/1949 | Ross | 83/425.1 |
| 2,508,868 | 5/1950 | Ross | 83/425.1 |
| 3,211,202 | 10/1965 | Mason | 83/425.1 X |
| 3,874,259 | 4/1975 | Chambos et al. | 83/9 |

*Primary Examiner*—Donald R. Schran
*Attorney, Agent, or Firm*—Christel & Bean

[57] ABSTRACT

A machine for cutting potatoes into multiple helical strips wherein the potato is rotated and moved toward a cutter having a series of parallel scoring knives projecting toward the potato and extending along a radial line with respect to the axis of rotation of the potato. A slicing blade likewise extending radially is disposed at right angles to the axis of rotation of the potato for continuously slicing off the scored portions. A carriage has a driving motor mounted thereon and the driving motor has a driven shaft which terminates in a potato-engaging and supporting element having prongs for engaging the potato to support the same and cause rotation thereof with said shaft. The machine has a base member to which the cutter is attached and the base member has longitudinal guide means at opposite sides thereof in which the carriage is guided for free longitudinal movement toward and away from the cutter in a direction parallel to the axis of rotation of the potato.

3 Claims, 6 Drawing Figures

POTATO CUTTING MACHINE

BACKGROUND OF THE INVENTION

The present invention relates to potato cutting machines and more particularly to machines for cutting continuous helical strips of potatoes preparatory to deep frying the same, such machines being particularly useful in restaurant operation.

A machine of this general type is shown in Ross U.S. Pat. No. 2,508,868, dated May 23, 1950. In this patent the potato or other vegetable is mounted at the end of a screw-threaded shaft which is screwed toward a stationary cutter. Prior art patent to Cupper et al U.S. Pat. No. 2,715,927 dated Aug. 23, 1955 shows a vegetable slicing machine having a cutting arrangement somewhat similar to that of the present apparatus but in the Cupper machine the vegetable is held stationary and the cutter rotates, the axis of rotation of the cutter being spaced to one side of the vegetable.

The machine of the present invention is a variation of a similar potato cutting machine disclosed and claimed in a copending application of James Chambos et al, Ser. No. 348,942, filed Apr. 9, 1973. The present inventor is a co-inventor in this copending application which now stands allowed.

SUMMARY OF THE INVENTION

In the present invention a carriage is supported for longitudinal movement toward a stationary cutter and the carriage contains an electric driving motor having its axis paralell to the direction of movement of the carriage toward the cutter blades. The carriage including the driving motor and a chuck carried thereby is freely manually movable toward the cutting mechanism to present the end of a potato against such cutting mechanism to score the potato along concentric vertical lines and then slice off the scored portions continuously to form helical potato strips suitable for deep frying.

In the machine of the present invention a horizontally extending base member has upstanding means fixed to one end thereof for supporting the cutter element above the base. The base has means extending upwardly along its opposite side edges which form longitudinal guides for the carriage which supports the driving motor and the potato engaging chuck, whereby the carriage is movable longitudinally of the base in the direction of the axis of the driving motor toward and away from the cutter.

DESCRIPTION OF THE ILLUSTRATED EMBODIMENT

Figure 1:
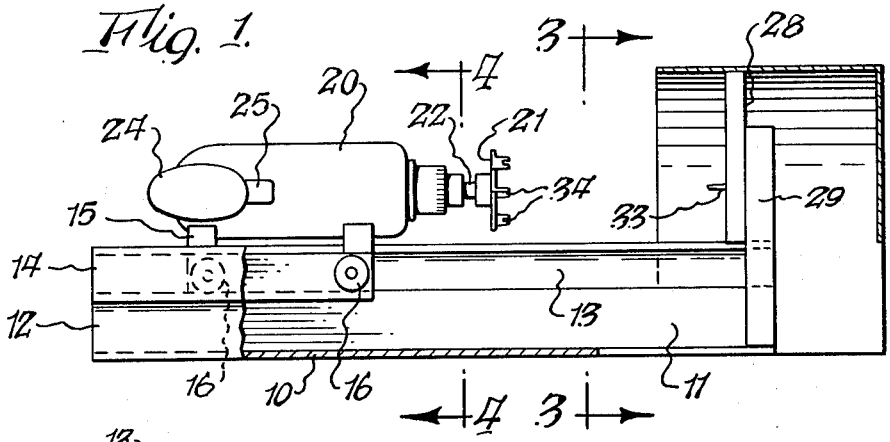
FIG. 1 is a general side elevational view of one form of the potato cutter of the present invention.

In the embodiment of the present invention illustrated in FIGS. 1 through 4 of the drawing the numeral 10 designates a horizontally extending base member which is provided with generally upstanding longitudinal flanges 11 and 12 along its opposite side edges. The flanges 11 and 12 are provided with channel formations 13 and 14 which provide guiding support for a carriage member 15.

The carriage 15 is supported for free longitudinal movement by means of longitudinally spaced pairs of rollers 16 mounted at opposite sides of the carriage which rollers track in the channel formations 13 and 14. A power unit is mounted on carriage 15 and includes a driving motor 20 and a potato supporting and engaging member 21 which is rotated on a longitudinal axis parallel to the direction of movement of carriage 15.

Figure 2:
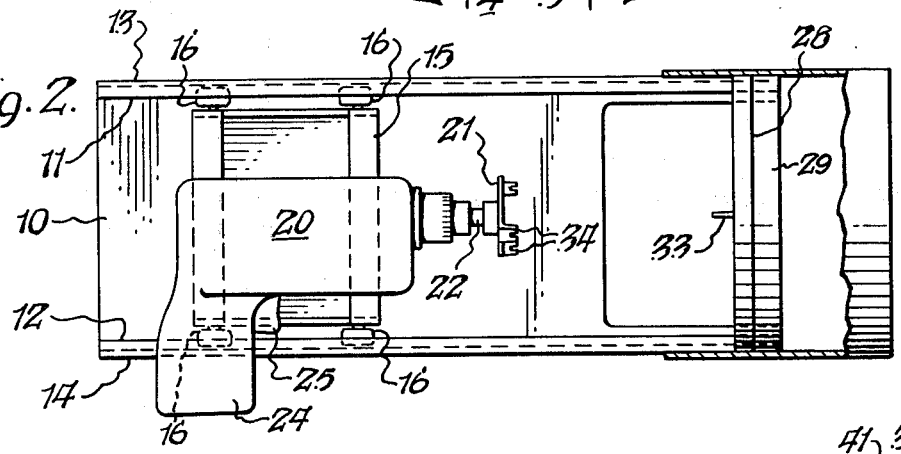
FIG. 2 is a top plan view thereof.

In the present instance the motor casing contains reduction gearing between the motor shaft and output shaft 22 and includes a laterally projecting handle 24 and a trigger switch 25. Thus a user, after inpaling a potato on potato-engaging member 21, may conveniently move the carriage 15 to the right as shown in FIGS. 1 and 2, which is toward a cutting mechanism which will presently be described, by merely grasping handle 24 and, when the potato reaches the cutting mechanism, cause rotation thereof by depressing the trigger switch 25.

The cutting mechanism is carried by a semi-circular plate 28 which is screwed to the inner face of an end wall 29 which extends upwardly from base member 10. The cutting elements are generally similar to the arrangement shown in Cupper U.S. Pat. No. 2,715,927 in that they provide a series of parallel cutters designated generally by the numeral 30 in FIG. 3 to score the face of the potato along concentric circular lines and a follow-up slicer comprising a blade 31 which continuously slices off the scored portion of the potato as the potato advances to the right as viewed in FIGS. 1 and 2.

However, in the aforesaid Cupper patent the vegetable is held stationary and is not concentric with the cutter so that the scoring knives cut across the face of the vegetable and not in concentric circles so that the scored strips subsequently sliced from the vegetable in Cupper are not continuous.

The cutter mounting plate 28 is provided with a pin 33 and a potato to be cut is held between pin 33 and potato-engaging member 21 and the carriage is advanced to the right to cause teeth 34 of potato-engaging member 21 to engage the potato and force the same over pin 33 so that the potato is firmly supported between prongs 34 and pin 33. Pin 33 is disposed closely adjacent to the inner end of the cutting edge of blade 31 as shown in FIG. 3 and is coaxial with the axis of rotation of potato-engaging member 21.

Motor 20 is then started and pressure is exerted to keep the potato in engagement against cutter support plate 28. Rotation of the potato is clockwise as viewed in FIG. 3 so that it first encounters the concentric scoring knives of the member 30 and then the blade 31 which slices off the scored portion of the potato and thus produces more or less continuous spiral strips of potato.

Figure 3:
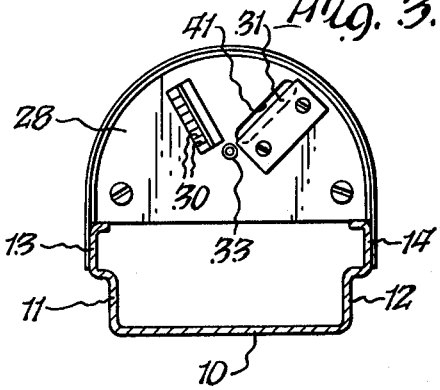
FIG. 3 is a cross-sectional view taken generally on the line 3—3 of FIG. 1.
Figure 4:
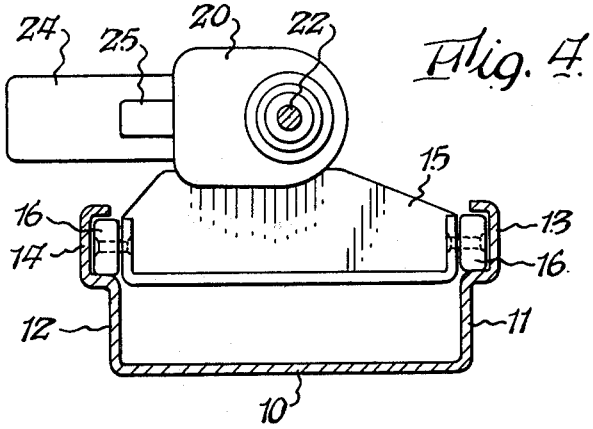
FIG. 4 is a cross-sectional view taken on the line 4—4 of FIG. 1.

As shown in FIG. 3 mounting plate 28 has an opening 41 through which the sliced-off strips of potato project so that they are delivered to the right of mounting plate 28.

Figure 5:
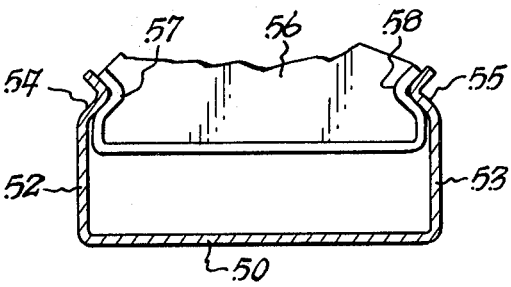
FIG. 5 is a fragmentary view similar to FIG. 4 showing a modified carriage guide means.
Figure 6:
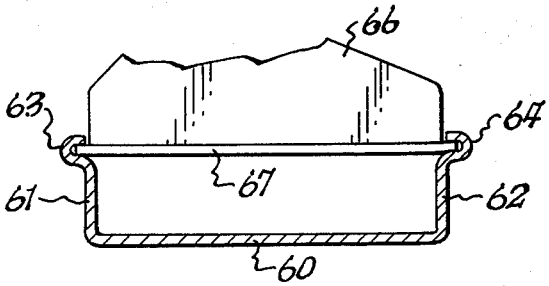
FIG. 6 is a fragmentary view similar to FIG. 4 showing a further modified carriage guide means.

In the alternative embodiments illustrated fragmentarily in FIGS. 5 and 6, the motor bearing carriage is mounted for horizontal sliding movement with respect to the fixed base of the machine. In FIG. 5 a base member 50 has longitudinal side walls 51 and 52 formed with horizontally extending inwardly bent V-shaped formations 54 and 55. A carriage 56 which is otherwise the same as the carriage 15 of FIGS. 1 through 4 has similar inwardly bent longitudinal formations 57 and 58 which interfit with the formations 54 and 55 of base member 50 and thus render the carriage 56 freely yieldable along base member 50 in a direction parallel to the axis of rotation of the motor and the potato engaging chuck.

In FIG. 6 a base member 60 has longitudinal side walls 61 and 62 which have return bent formations 63 and 64 along their upper edges which form guiding channels. The carriage 66 of the embodiment of FIG. 6 has a base plate member 67 whose longitudinal side edges bear in the channels formed by the return bent formations 63 and 64, thus similarly guiding the carriage 66 for free longitudinal movement relative to base member 60.

Preferred embodiments of the present invention have been described and illustrated herein to illustrate the principles of the invention but it is to be understood that numerous modifications may be made without departure from the broad spirit and scope of the invention.

I claim:

1. A vegetable cutter comprising a longitudinally extending frame member which is channel shaped in transverse cross section and comprises a base portion and side walls extending upwardly at the opposite longitudinal edges of said base portion, a cutter support fixed to one end thereof, means for presenting an article of vegetable to said cutter support comprising a carriage and means supporting said carriage for guided linear movement toward and away from said cutter support, a driving motor on said carriage including an output shaft having vegetable engaging means at one end thereof toward said cutter support, said shaft being rotatable on an axis parallel to the direction of movement of the carriage, said cutter support including a series of parallel blades projecting toward said carriage and extending in a radial row with respect to the axis of said shaft to score said vegetable along concentric circles, and a slicing blade extending generally at right angles to said shaft axis and spaced toward said carriage from said cutter support for continuously slicing said scored portions during rotation of said shaft to form a series of helical strips of said vegetable, said carriage supporting and guiding means comprising longitudinal guiding formations extending along said frame member side walls, and means on said carriage engaging said guiding formations for free movement of said carriage longitudinally of said frame member, said carriage being movable manually to hold said vegetable against said cutter support during operation of said cutter to produce sliced strips of uniform thickness.

2. A vegetable cutter according to claim 1 wherein the guide means on said carriage comprises pairs of longitudinally spaced rollers at opposite sides thereof for free rolling engagement with the guiding formations of said frame member side walls.

3. A vegetable cutter according to claim 1 wherein the guide means on said carriage comprises longitudinally extending formations interfitting with the longitudinally guiding formations of said frame member side walls.

* * * * *